US006109049A

United States Patent [19]

Wetherell

[11] Patent Number: 6,109,049

[45] Date of Patent: Aug. 29, 2000

[54] SYSTEM FOR COOLING OUTDOOR GOLF PRACTICE TEES

[76] Inventor: Bruce B. Wetherell, 1360 Highland Dr., Clearwater, Fla. 33764

[21] Appl. No.: 09/260,278

[22] Filed: Mar. 2, 1999

Related U.S. Application Data

[63] Continuation-in-part of application No. 09/115,208, Jul. 14, 1998.

[51] Int. Cl.[7] ..... F25B 19/00

[52] U.S. Cl. ..... 62/231; 62/441; 62/458; 236/1 B; 454/253

[58] Field of Search ..... 236/1 B; 62/440, 62/441, 442, 447, 458, 259.1, 256, 231; 454/253

[56] References Cited

U.S. PATENT DOCUMENTS

| | | | |
|---|---|---|---|
| 2,660,407 | 11/1953 | Lehane | 257/3 |
| 3,123,988 | 3/1964 | Richmam | 62/418 |
| 3,233,422 | 2/1966 | Kobrin . | |
| 3,982,407 | 9/1976 | Guenette . | |
| 3,999,764 | 12/1976 | Nitsche | 273/176 AB |
| 4,045,023 | 8/1977 | Heffley, Jr. | 273/35 B |
| 4,280,335 | 7/1981 | Perez et al. . | |
| 4,315,415 | 2/1982 | Wilson . | |
| 4,345,443 | 8/1982 | Yamashita . | |
| 4,835,983 | 6/1989 | Chandler et al. . | |
| 4,889,342 | 12/1989 | Hugunin . | |
| 4,905,475 | 3/1990 | Tuomi . | |
| 4,928,750 | 5/1990 | Nurczyk | 165/2 |
| 5,011,152 | 4/1991 | Hugunin | 273/176 R |
| 5,076,346 | 12/1991 | Otsuka | 165/22 |
| 5,161,608 | 11/1992 | Osheroff | 165/22 |
| 5,179,524 | 1/1993 | Parker et al. | 364/505 |

*Primary Examiner*—William Doerrler
*Assistant Examiner*—Marc Norman
*Attorney, Agent, or Firm*—Larson & Larson, P.A.; James E. Larson

[57] ABSTRACT

A system for cooling outdoor golf practice tees is incorporated into a practice facility including a building that houses, perhaps, five or so practice tees, each of which is partially enclosed by building structure. Within the ceiling of the building, a single air conditioning unit is mounted having an outlet connected to an elongated manifold and within each enclosure, a vent is provided connected to the manifold and having a louvered outlet allowing adjustment of the direction of air flow from the outlet. A blower motor is located in the duct supplying air to the vent from the manifold and the blower motor includes a fan directed such that rotations of the motor result in blowing of conditioned air through the vent. Each enclosure includes a check control mechanism designed to receive money and responsive to receipt of the proper amount activating the blower motor for a prescribed period of time. Alternatively, one air conditioner can service both sides of a practice tee enclosures with a conduit from the manifold serving partitions on each side of the practice tee. A louvered outlet is mounted on each side partition of the practice tee enclosure.

15 Claims, 7 Drawing Sheets

SYSTEM FOR COOLING OUTDOOR GOLF PRACTICE TEES

This application is a continuation-in-part from Application Ser. No. 09/115,208 filed Jul. 14, 1998 (co-pending).

BACKGROUND OF THE INVENTION

The present invention relates to a system for cooling outdoor golf practice tees.

It is well known to provide a driving range with practice tees that are at least partially enclosed by a building structure to provide protection so that a golfer can practice during inclement weather. However, especially during the spring and summer months, such an enclosure often becomes hot and stuffy since the temperature becomes somewhat higher than room temperature and the enclosure prevents adequate air circulation.

Accordingly, it would be advantageous to provide such an enclosure with an air conditioning system allowing the golfer to maintain the temperature adjacent the golf tee to within a reasonable range of temperatures.

Since such a system would require a financial expenditure on the part of the owner of the driving range, it would also be advantageous if some means could be incorporated into such a system that would permit the owner of the driving range to recoup some of the expenses of the installation by charging each golfer for the use of the air conditioning system.

It is with these needs in mind that the present invention was developed.

The following prior art is known to Applicant:

U.S. Pat. No. 3,233,422 to Kobrin discloses a refrigeration system that supplies refrigerated air from a single source thereof to a plurality of refrigerated enclosures. The present invention differs from the teachings of Kobrin as contemplating a plurality of partial enclosures, each of which has a golf tee located therein and wherein individual louvered vents supply conditioned air within each partial enclosure responsive to payment of a fee to a check control mechanism.

U.S. Pat. No. 3,982,407 to Guenette discloses a garbage container unit divided into sections by partial boards detachably mounted within each section and with a refrigeration system directing cooled air to each of the compartments. The present invention differs from the teachings of Guenette as contemplating a plurality of partial enclosures, each of which has a golf tee located therein and wherein individual louvered vents supply conditioned air within each partial enclosure responsive to payment of a fee to a check control mechanism.

U.S. Pat. No. 4,280,335 to Perez et al. discloses an icebank system for refrigerating numerous produce areas and providing air conditioning in a supermarket. The Perez et al. system directs cooled air from a single air conditioning unit to a plurality of separate spaces. The present invention differs from the teachings of Perez et al. as contemplating a plurality of partial enclosures, each of which has a golf tee located therein and wherein individual louvered vents supply conditioned air within each partial enclosure responsive to payment of a fee to a check control mechanism.

U.S. Pat. No. 4,315,415 to Wilson discloses an air conditioning unit with a provision for ducting to convey conditioned air to a plurality of rooms. The present invention differs from the teachings of Wilson as contemplating a plurality of partial enclosures, each of which has a golf tee located therein and wherein individual louvered vents supply conditioned air within each partial enclosure responsive to payment of a fee to a check control mechanism.

U.S. Pat. No. 4,345,443 to Yamashita discloses an apparatus for lowering the temperature of articles wherein a source of conditioned air supplies the air to a number of chambers. The present invention differs from the teachings of Yamashita as contemplating a plurality of partial enclosures, each of which has a golf tee located therein and wherein individual louvered vents supply conditioned air within each partial enclosure responsive to payment of a fee to a check control mechanism.

U.S. Pat. No. 4,835,983 to Chandler, Jr. et al. discloses a kiosk with air conditioning wherein conditioned air is blown at a region of a kiosk where a user will be receiving services, such as receipt of money at an automatic teller machine. The present invention differs from the teachings of Chandler, Jr. et al. as contemplating a plurality of partial enclosures supplied with conditioned air from a single source thereof responsive to payment of a fee to a check control mechanism.

U.S. Pat. No. 4,889,342 to Hugunin discloses an all-weather golf driving range including a single partial enclosure provided with means to supply a curtain of warm air. The present invention differs from the teachings of Hugunin as contemplating a golf driving range wherein a multiplicity of partial enclosures are supplied with cooled air from a single source thereof and wherein a check control mechanism is employed to allow receipt of payment resulting in activation of the cooling means for a timed period.

U.S. Pat. No. 4,905,475 to Tuomi discloses a personal comfort conditioner that includes means for directing cooled air down onto the head of an individual. The present invention differs from the teachings of Tuomi as contemplating a single source of conditioned air that allows supply of cooled air to a plurality of separate partial enclosures responsive to payment within one of the enclosures of a set fee to a check control mechanism.

SUMMARY OF THE INVENTION

The present invention relates to a system for cooling outdoor golf practice tees. The present invention includes the following interrelated objects, aspects and features:

(1) In a first aspect, it is contemplated that the present invention will be incorporated into a practice facility including a building that houses, perhaps, five or so practice tees, each of which is partially enclosed by building structure. Each such enclosure encloses the golfer from behind and to the sides while leaving the forward direction open so that the golfer can hit golf balls out the forward opening and toward the target area.

(2) Within the ceiling of the building, a single air conditioning unit is mounted which may, if desired, be of a size and rating so as to provide approximately one ton of cooling per enclosure. Thus, for example, where the building includes five enclosures, a five ton air conditioning unit would be preferred so that one ton of cooling capacity is supplied to each enclosure. The outlet of the air conditioning unit is connected to an elongated manifold.

(3) Within each enclosure, a vent is provided having a louvered outlet allowing adjustment of the direction of air flow from the outlet. A blower motor is located in the duct supplying air to the vent from the manifold and the blower motor includes a fan directed such that rotations of the motor result in blowing of conditioned air through the vent.

(4) Each enclosure includes a check control mechanism designed to receive money and responsive to receipt of the proper amount activating the blower motor for a prescribed period of time. Thus, for example, providing the check control mechanism with four quarters will provide 40 minutes of cooling within the enclosure.

(5) An alternative embodiment directs an air conditioning conduit through a vertical partition between enclosures so that air is vented directly to a golfer's chest area.

Accordingly, it is a first object of the present invention to provide a system for cooling outdoor golf practice tees.

It is a further object of the present invention to provide such a system wherein a single air conditioning unit supplies cooled conditioned air to a multiplicity of separate enclosures.

It is a still further object of the present invention to provide such a system wherein each enclosure has a vent with louvers and with a blower motor within the vent controlled by a check control mechanism.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
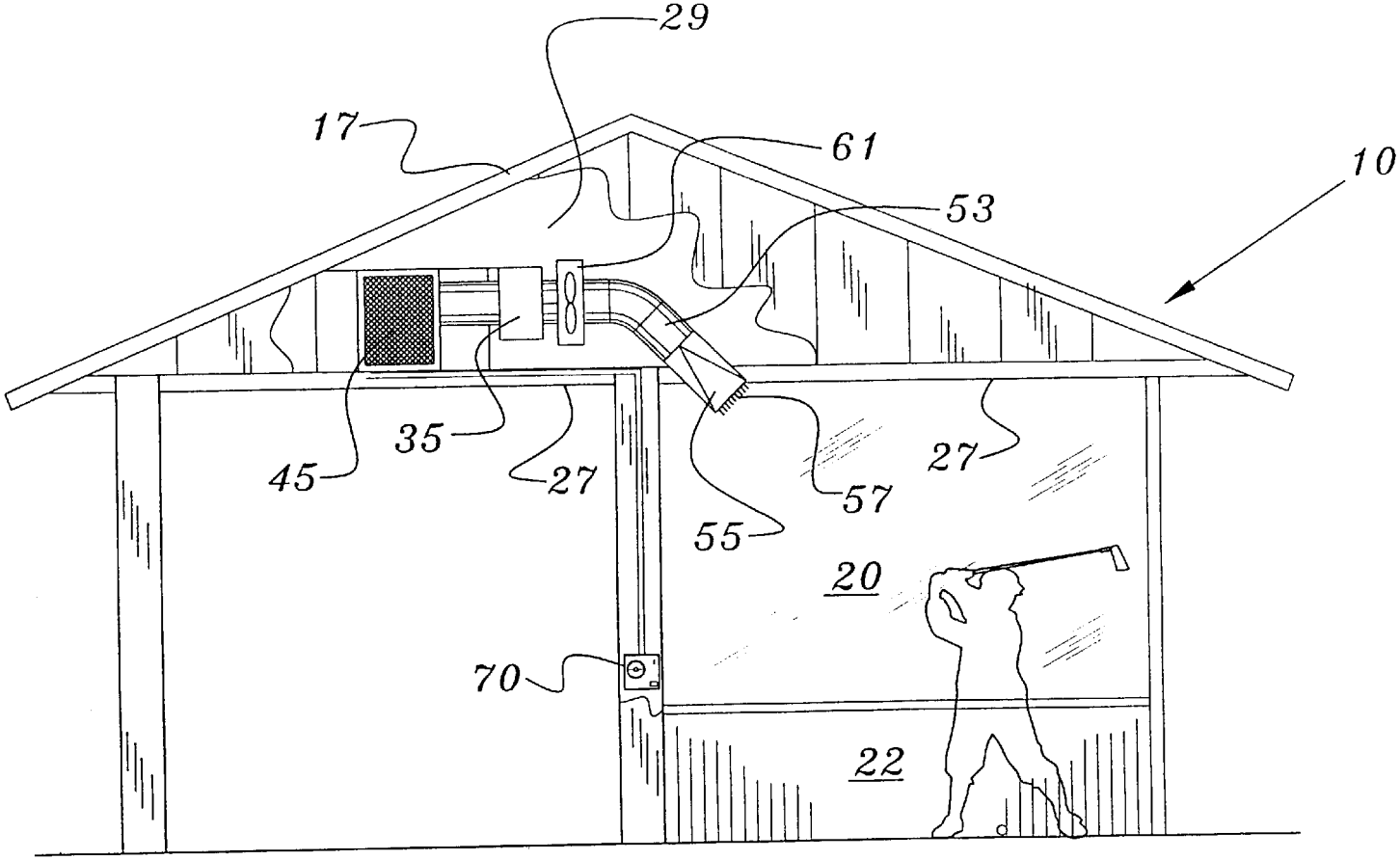
FIG. 1 shows a side view of a building including a rear access enclosure, and a golf practice tee.

With reference, first, to FIGS. 1–4, a building is generally designated by the reference numeral 10 and is seen to include side walls 11 and 13, a rear wall 15, a roof 17 and an open front 19. The front 19 of the building 10 is kept open to allow golf balls struck by the user's club to fly out of the building and toward the target range (not shown). The rear wall 15 includes five doors 21, each of which leads to a separate tee box or enclosure 23 within the building 10, with the tee boxes or enclosures 23 being defined within the building 10 by partition walls 25. The partitions or walls 25 between adjacent enclosures 23 consist of lower portions 22 (FIG. 1) made of a suitable material such as, for example, a composite foam-fiberglass panel and upper portions 20 (FIG. 1) made of a strong, transparent material such as an acrylic plastic sold under the Trademark "PLEXIGLAS".

Figure 3:
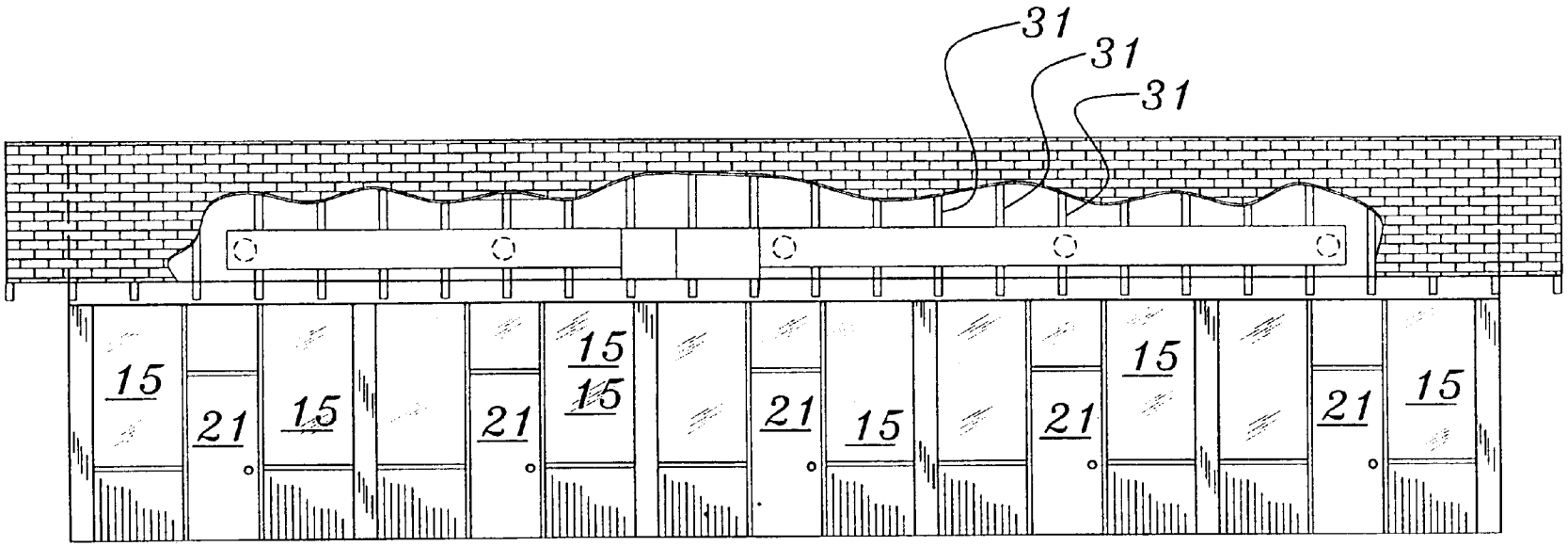
FIG. 3 shows a rear view of the building shown in FIGS. 1 and 2 with portions broken away to show detail.
Figure 4:
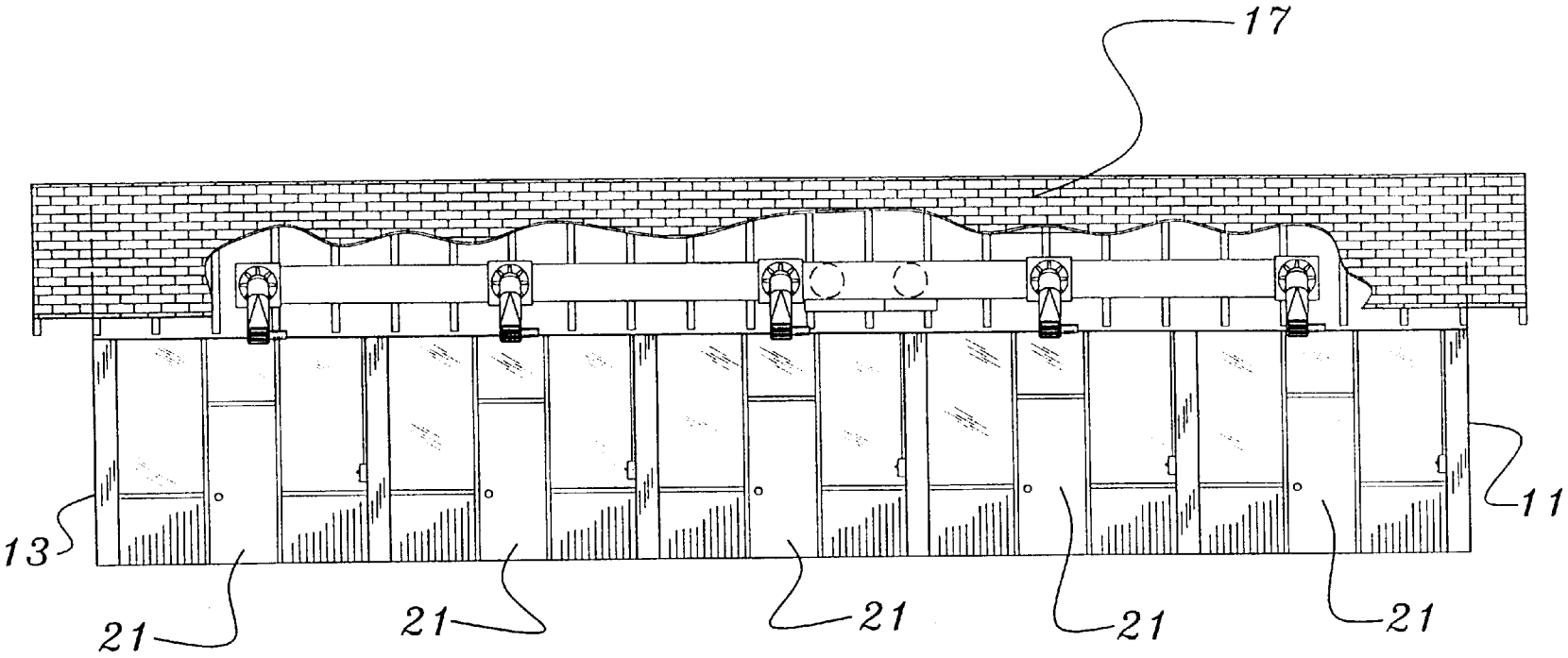
FIG. 4 shows a view looking rearwardly from within the building with portions broken away to show detail.

A common ceiling 27 (best seen in FIG. 1) defines, with the roof 17, an attic 29. The beams 31 that support the roof structure are seen in FIGS. 3 and 4.

Figure 2:
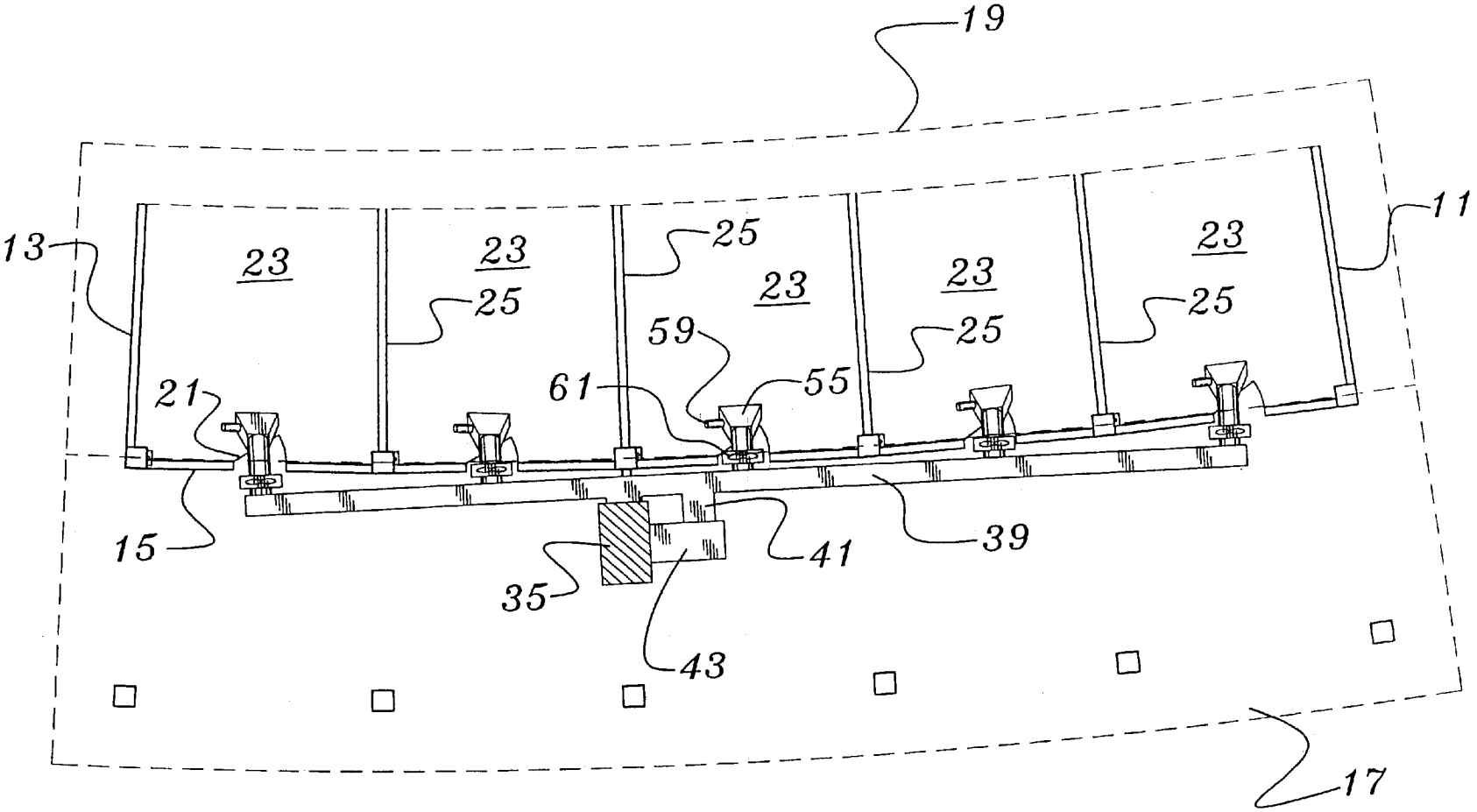
FIG. 2 shows a longitudinal cross-section horizontally through the building of FIG. 1.
Figure 5:
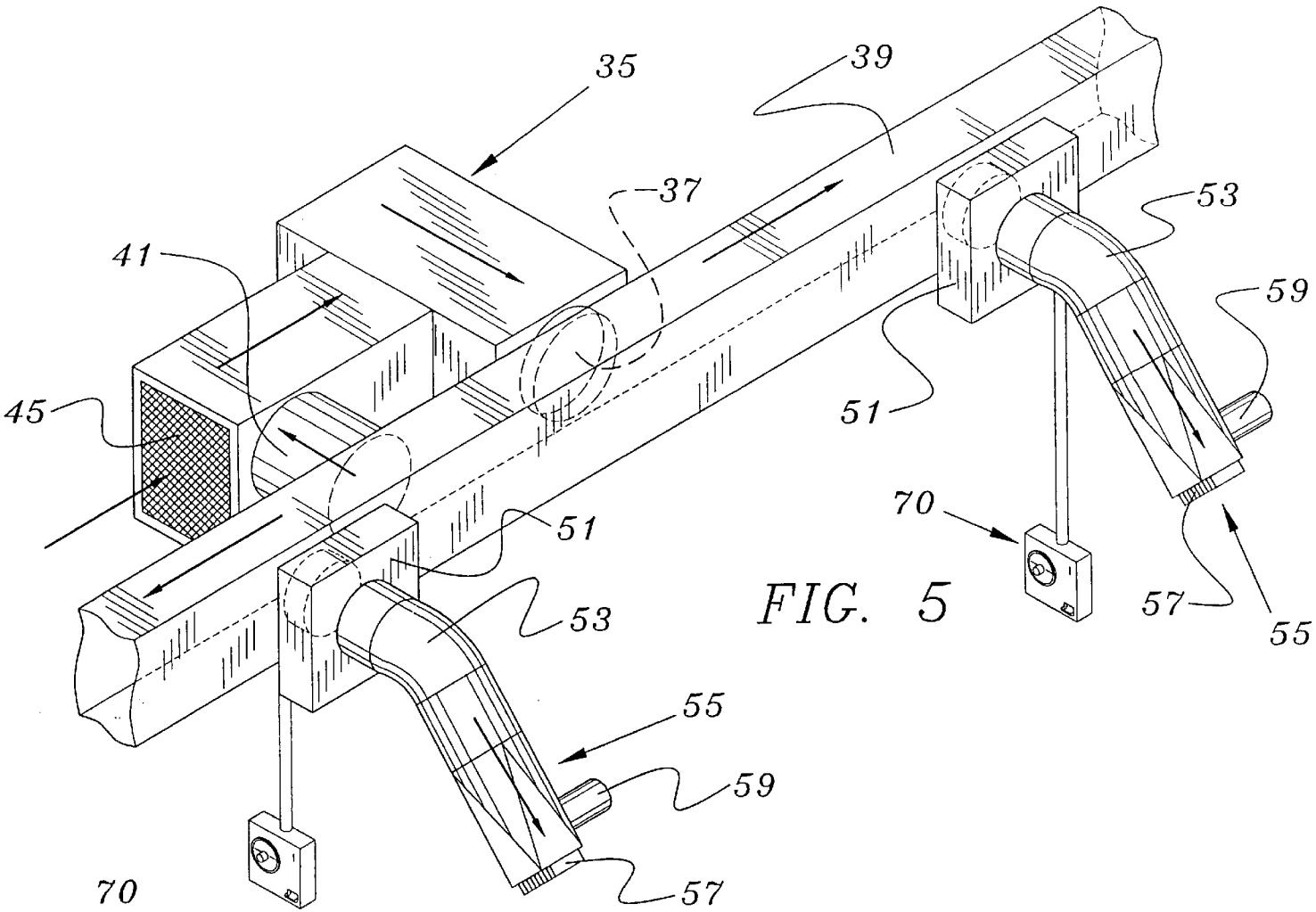
FIG. 5 shows a detailed perspective view of the ventilation system of the present invention.

With reference to FIGS. 2 and 5, within the attic 29, an air conditioning unit 35 is mounted that includes an outlet 37 through which cooled and conditioned air is forced. With reference to FIG. 2, the outlet 37 is connected to an elongated manifold 39 that extends within the attic 29. A bypass line 41 extends from the manifold 39 (FIG. 2) and connects with the inlet 43 that includes a filter 45 (FIGS. 1 and 5) that filters air before it enters the air conditioning unit 35.

With particular reference to FIG. 5, it is seen that the manifold 39 has several outlets therefrom, each of which is designated by the reference numeral 51. Each outlet 51 has connected thereto a conduit 53 that leads to an outlet vent 55 including a series of adjustable louvers 57. Blower means includes a blower motor 59 immediately adjacent the outlet 55 that is activated in a manner to be described in greater detail hereinafter.

Figure 6:
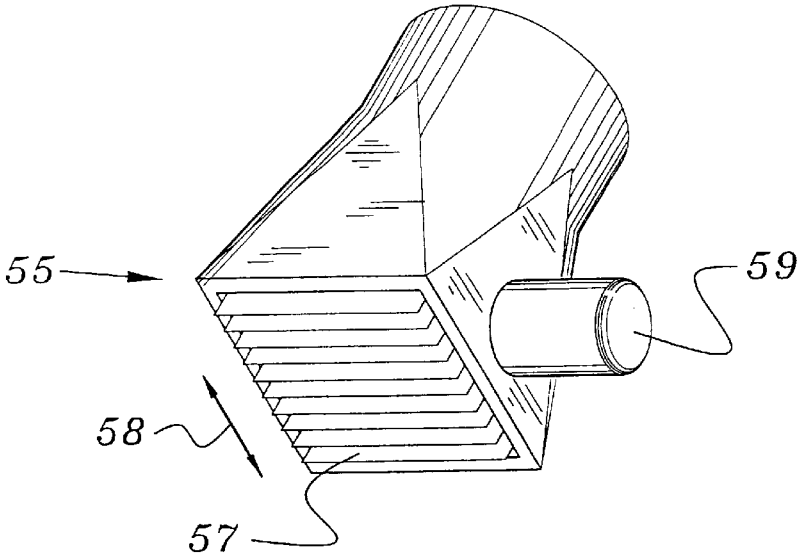
FIG. 6 shows a perspective view of one of the vents of the ventilation system.

Within each outlet 51, the blower means further includes a fan 61 (FIGS. 1 and 2). Through a mechanism (not shown), the blower motor 59 has an output shaft suitably coupled to the fan 61 such that activation of the blower motor 59 results in rotation of the fan 61 to blow conditioned cooled air out from the outlet vent 55. With reference to FIG. 6, the louvers 57 are shown in greater detail and the double-ended arrow 58 is provided to depict the fact that the louvers 57 travel in unison and are pivoted upwardly or downwardly in the view of FIG. 6 to direct conditioned cooled air flowing from the outlet 55 in any desired direction.

Figure 7:
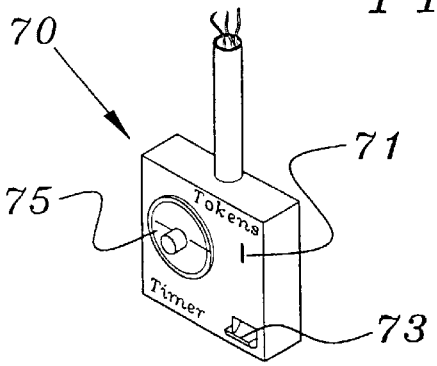
FIG. 7 shows an enlarged perspective view of the check control mechanism of the present invention.
Figure 8:
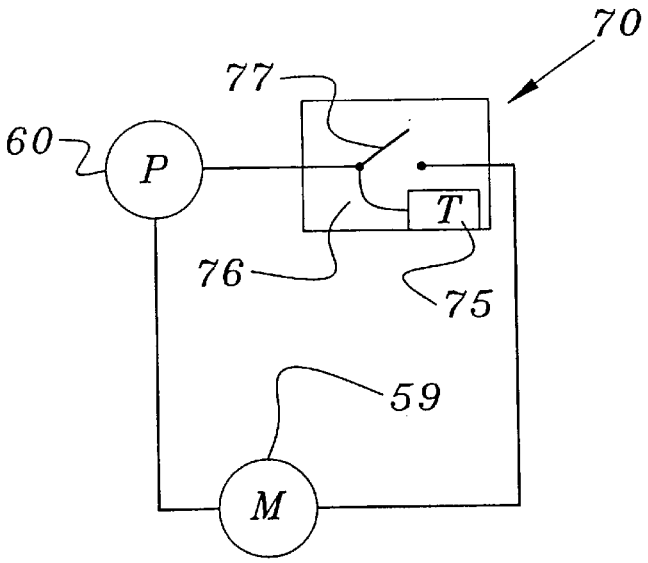
FIG. 8 shows a schematic representation of the electrical circuitry of the present invention.

With particular reference to FIGS. 1, 5 and 7, a check control mechanism 70 is seen to include a coin slot 71, a coin return 73 and a timer mechanism schematically depicted and referred to with reference numeral 75. As should be understood, when coins are received in the coin slot 71, the user may purchase a desired amount of time during which the blower motor 59 is activated to activate the fan 61 and blow conditioned cooled air within the enclosure 23 where the user is located. As shown in the schematic circuit of FIG. 8, the motor 59 is connected with a source of electrical power 60 and the check control mechanism 70 is included in the electrical circuit and includes an internal switch 77 that is closed by the check control mechanism 70 responsive to receipt of coins or tokens within the slot 71. The timer mechanism 75 also described in FIG. 8 with the reference letter "T" is seen as acting to control the switch 77 by the schematic actuator 76. If, for example, the depositing of 25 cents gives the user 10 minutes of air conditioning through the outlet vent 55, the timer mechanism 75 closes the switch 77 for ten minutes and then, at the conclusion of 10 minutes, opens the switch 77. Thus, under this scenario, four quarters or 25 cent tokens deposited within the slot 71 will result in the receipt of conditioned air through the outlet vent 55 of the particular enclosure 23 for a period of 40 minutes.

The air conditioning unit 35 is operated continuously under the control of the owner of the building 10 and associated driving range.

In the preferred embodiment, in one preferred design of the present invention, each of the enclosures 23, also termed tee boxes, are made approximately 12'×12' in dimensions with a ceiling height of at least 11'.

The outlet vent 55, best seen in FIG. 6, may have dimensions of 24"×24" and the motor 59 may, if desired, generate ⅛ horsepower to provide suitable power for rotating each fan 61.

Based upon the dimensions of each enclosure or tee box 23, the air conditioning unit 35 is required to have approximately one ton of air conditioning rating for each enclosure or tee box 23. Thus, in the example shown as best seen in FIG. 2, wherein five such enclosures or tee boxes 23 are provided, the air conditioning unit 35 would have a rating of 5 tons.

If desired, the air conditioning unit 35 is replaced with a heat exchanger system wherein a fan (not shown) blows air across tubes (not shown) carrying cool water to cool the air that is then circulated via the manifold 39 in the manner described hereinabove. Such cool water could be supplied to the heat exchanger from underground tubes in a manner well understood to those skilled in the art.

In the system described hereinabove wherein a 5 ton air conditioning unit 35 is employed to supply cooled conditioned air to five enclosures or tee boxes 23, such an air conditioning unit 35 will output in the range of 400 to 1800 cubic feet per minute (CFM) of cooled conditioned air.

Figure 9:
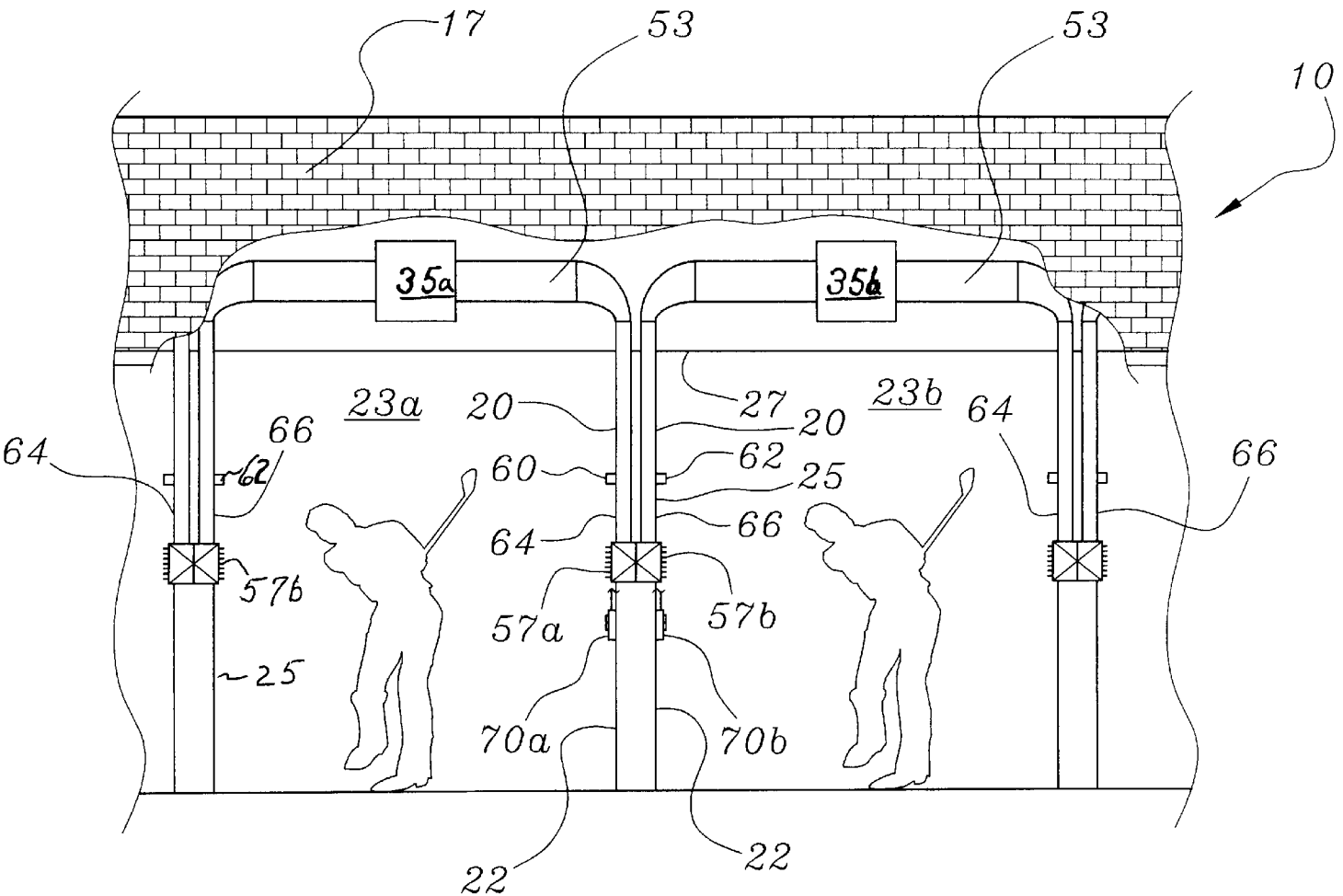
FIG. 9 shows a front view of a portion of the building including two separate tee enclosures.

An alternate system is shown in FIG. 9 where a single air conditioner 35*a* of about two tons capacity has its conduit 53 leading downward to smaller conduits 64 and 66 for cooling enclosure 23*a*. A golfer in enclosure 23*a* activates the unit by placing coins in the coin slot 71 of the check control box 70*a*. The conduit 66 within a partition 25 directs cool air through louvers 57*b* towards the chest of a right-handed golfer. The conduit 64 within a partition 25 leads cool air through louvers 57*a* towards the back of the golfer. The blower motor 60 draws cool air through conduit 64 to louver 57*a* and blower motor 62 draws cool air through conduit 62 to louver 57*b*. In like manner, a golfer in enclosure 23*b* activates check control box 70*b* to generate cool air from air conditioner 35*b*.

Accordingly, an invention has been disclosed in terms of a preferred embodiment thereof which fulfills each and every one of the objects of the invention as set forth hereinabove and provides a new and useful system for cooling outdoor golf practice tees of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. In a building having a plurality of enclosures, each of which is at least partially open in a forward direction, the improvement comprising an air conditioning system for said building and including:

a) an air conditioner having an air inlet and an outlet for conditioned and cooled air;

b) a manifold connected to said outlet and extending in adjacency to each of said enclosures;

c) a conduit within each enclosure having a first end connected to said manifold and a second end having an outlet vent; and d) a separate fan within each conduit for conveying conditioned cold air from said manifold to a said enclosure, the fan operated by a motor including check control means for controlling timed operation of the motor.

2. The improvement of claim 1, wherein said air inlet includes a bypass connected to said manifold.

3. The improvement of claim 1, wherein said outlet vent comprises a plurality of louvers operable in unison to enable adjustment of a direction of air flow from said vent.

4. The improvement of claim 1, wherein said check control means includes a coin or token receiving slot and a timer, whereby receipt of one or more coins or tokens is sensed by said check control means which therafter activates a said motor for a pre-set time period.

5. The improvement of claim 1, wherein said vent is rectangular.

6. The improvement of claim 1, wherein said air inlet includes a filter.

7. The improvement of claim 1, wherein said air conditioner includes a heat exchanger that circulates cool liquid through tubes and air is cooled by blowing it past the tubes.

8. A building having a plurality of enclosures, each of which is at least partially open in a forward direction, and an air conditioning system for said building and including:

a) an air conditioner having an air inlet having a filter and an outlet for conditioned and cooled air;

b) a manifold connected to said outlet and extending in adjacency to each of said enclosures;

c) a conduit within each enclosure having a first end connected to said manifold and a second end having a rectangular louvered outlet vent;

d) blower means within each conduit for conveying conditioned cold air from said manifold to a said enclosure, said blower means comprising a separate fan in each said conduit adjacent said manifold and further comprising a separate motor connected to each said fan; and e) check control means for controlling timed operation of each said motor, wherein said check control means includes a coin or token receiving slot and a timer, whereby receipt of one or more coins or tokens is sensed by said check control means which thereafter activates a said motor for a pre-set time period.

9. The building according to of claim 8, wherein said air inlet includes a bypass connected to said manifold.

10. The building according to of claim 8, wherein said outlet vent comprises a plurality of louvers operable in unison to enable adjustment of a direction of air flow from said vent.

11. The building according to of claim 8, wherein said air conditioner includes a heat exchanger that circulates cool liquid through tubes and air is cooled by blowing it past the tubes.

12. In a building having a plurality of enclosures, each open in a forward direction, (a) multiple air conditioners each having an air inlet and an outlet for conveying conditioned cooled air;

(b) the outlet connected to two conduits, one leading to a partition on one side of one enclosure and the second leading to an opposite side partition separating the enclosure from an adjacent enclosure; and (c) a blower mounted within each conduit for conveying conditioned air from the conditioner to the enclosure.

13. The building according to claim 12 wherein each conduit leads to a plurality of louvers mounted on a partition wall operable in unison to enable adjustment of a direction of air flow from the conduit.

14. The building according to claim 13 wherein the air conditioned air is blown directly on a golfer within the enclosure.

15. The building according to claim 14 wherein the golfer activates the air conditioner by placing a coin or token in a coin receiving box electrically connected to the air conditioner.

* * * * *